United States Patent [19]

Rosegren et al.

[11] 4,265,715

[45] May 5, 1981

[54] SILVER ELECTRODEPOSITION PROCESS

[75] Inventors: Donald R. Rosegren, DuMont; Noreen C. Johnson (Bulsiewicz), Maywood, both of N.J.; Peter Stevens, Hacienda Heights, Calif.

[73] Assignee: Oxy Metal Industries Corporation, Warren, Mich.

[21] Appl. No.: 57,471

[22] Filed: Jul. 13, 1979

[51] Int. Cl.[3] ..... C25D 3/46

[52] U.S. Cl. ..... 204/46 R; 204/46 R

[58] Field of Search ..... 204/46 R, 43 R, 109; 106/1.19

[56] References Cited

U.S. PATENT DOCUMENTS 2,097,630 11/1937 Lutz ..... 204/50 Y 3,706,635 12/1972 Kowalski ..... 204/46 R 3,914,162 10/1975 Kowalski ..... 204/46 R X

FOREIGN PATENT DOCUMENTS 1419613 12/1975 United Kingdom ..... 204/46 R

*Primary Examiner*—G. L. Kaplan

*Attorney, Agent, or Firm*—Richard P. Mueller

[57] ABSTRACT

Compositions for electrodepositing silver, comprising a soluble silver compound, a non-cyanide electrolyte and selected organic phosphonate compounds, are described. These are stable for prolonged periods and are capable of depositing silver at relatively high rates without the need for soluble silver electrodes or cyanide replenishment to the bath, in contrast to conventional procedures.

5 Claims, No Drawings

SILVER ELECTRODEPOSITION PROCESS

FIELD OF THE INVENTION

This invention relates to the electrolytic deposition of silver on metal surfaces, generally, and to the stabilization of silver electrodeposition compositions and processes, in particular.

BACKGROUND OF THE INVENTION

In conventional methods of electrolytically depositing silver, cyanide is commonly used as an electrolyte or as an additive to the bath. Such baths tend to be unstable unless soluble silver electrodes are used, and when operated at high current densities especially, e.g., above 800 amperes per square foot, the resulting silver deposit usually lacks sufficient smoothness.

In certain procedures where silver is electrodeposited at higher current densities, for example, in the manufacture of miniature components for electronic circuitry, substantially insoluble, non-silver electrodes are required and silver electrodes are precluded. In such procedures, the bath tends to be unstable and the smoothness and evenness of the silver deposit is usually adversely affected.

OBJECTS OF THE INVENTION

It is an object of this invention to provide stable compositions for electrolytically depositing metallic silver at high current densities.

It is another object of this invention to provide stable processes for electrodepositing metallic silver while avoiding the need for soluble silver electrodes.

It is another object of this invention to provide compositions and processes for depositing metallic silver without dependence on cyanide as an electrolyte.

These and other objects which will be apparent from the following description are achieved by practice of this invention.

DESCRIPTION OF THE INVENTION

The compositions of the invention comprise a mixture of:

(a) a soluble silver compound;

(b) a non-cyanide electrolyte; and (c) an effective amount of an organic phosphonate compound selected from among the following:

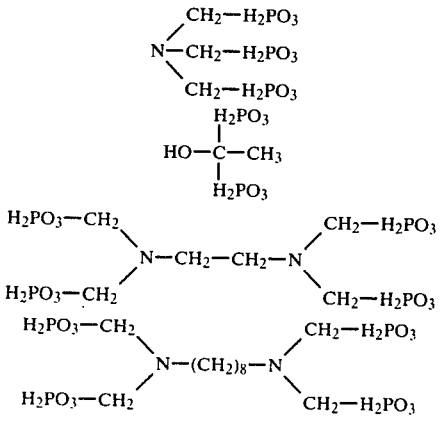

(I)

(II)

(III)

(IV)

and

-continued

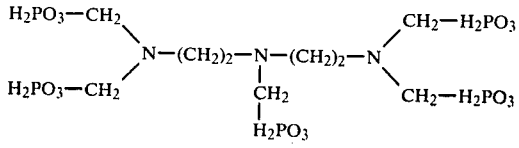

(V)

The ingredients may be mixed together to form a saleable article of commerce which is then added to water, with the pH adjusted to be above 7 preferably, or the ingredients may be added separately to water to form the bath.

The invention also comprises the improved method of electrodepositing silver from a bath comprising an aqueous solution of a silver compound, and more specifically, the improvement which serves to stabilize the bath and to enhance the smoothness of the silver deposit, especially when the bath is operated at current densities above 800 amperes per square foot.

The organic phosphonate compounds are commercially available from Monsanto Company, Inc., under the name "Dequest", or they can be prepared by following known procedures described in the chemical literature.

The electrolyte for the bath, in general, is selected from among non-cyanide compounds capable of dissolving in water to form ions. Usually, these are soluble alkali metal compounds, and preferably, phosphates, citrates, nitrates or carbonates of potassium or sodium.

The silver compound is preferably a water soluble inorganic compound capable of being dissolved in the bath at room or slightly elevated temperatures within the operating range of the bath. Examples of such compounds include potassium silver cyanide, silver chloride, silver nitrate, silver nitrite and silver bromide.

In general, the compositions of the invention are formulated within the following preferred ranges, and operated under the following conditions of pH and temperature:

| INGREDIENTS | AMOUNT | |
|---|---|---|
| Soluble silver compound, preferably potassium silver cyanide | 50–90 | g/l as silver |
| Soluble non-cyanide compound, preferably potassium citrate | 90–110 | g/l |
| Organic phosphonate compound | 20–40 | g/l |
| pH | 7–10 | |
| Temperature | 50–70° C. | |

The pH is adjusted by adding suitable amounts of a weak acid, preferably citric acid or phosphoric acid, or a base, preferably potassium hydroxide or potassium carbonate.

The bath is operated usually at current densities above 800 amperes per square foot, and more usually between about 1,000 and 2,000 amperes per square foot, using conventional non-silver electrodes which are substantially insoluble in the bath, e.g., solid platinum wire or mesh, or platinum coated tantalum or columbium.

Plating is conducted for a period sufficient to obtain a silver deposit of the desired thickness. In general, at the indicated conditions of temperature and current density, a period of about 3 seconds or less is sufficient to deposit a layer of silver having a thickness of 130–150 micro-inches. The plating period may be shortened or extended accordingly to achieve any other desired thickness.

Using this invention, substantially smooth, adherent silver deposits are provided, with suitable preparation, on virtually any metal surface, such as copper, nickel, silver, steel and alloys thereof, such as brass, bronze, stainless steel, and the like.

Other ingredients conventionally used in silver electrodeposition baths may also be included. Special mention is made of brightening agents for enhancing the brightness of the silver deposit. Any conventional brightening agents used in silver plating processes can be employed. Preferred for such purposes are water soluble salts of a metal or metals selected from among arsenic, e.g., arsenic trioxide, lead, e.g., lead citrate, thallium, e.g., thallium chloride, bismuth, e.g., bismuth molybdate and antimony, e.g., antimony chloride. These are usually added in small amounts, e.g., from about 1 to about 10 parts (as metal) per million parts by weight of the total composition.

Other conventional inorganic or organic brightening agents, such as mercaptobenzothiazole, thiazole or thiocyanate, may be used in place of, or together with the foregoing.

DESCRIPTION OF THE PREFERRED EMBODIMENTS

The compositions, processes and procedures of this invention are illustrated in the following examples.

EXAMPLE 1

In accordance with this invention, a copper strip, suitably cleaned to remove any surface dirt or grease, is mechanically masked to allow the area for deposition to be exposed in a selective plating head commercially available from the Dynacraft Corp. to a silver bath having the following composition:

| | |
|---|---|
| Potassium silver cyanide | 60 g/l |
| Potassium citrate | 100 g/l |
| Organic phosphonate compound I | 30 g/l |
| pH | 7–10 |

The anode consists of pure platinum wire. The current source is an 8-volt d.c. power supply. The current density is maintained at 1500 amperes per square foot during the plating period. The temperature is not permitted to go below 65° C. nor above 70° C. while plating takes place.

Within 3 seconds, a metal deposit having a thickness of 150 micro-inches is obtained, and the copper strip is removed from exposure to the bath. The semi-bright silver deposit is substantially smooth and even, and displays good adhesion to the substrate even when rubbed.

For purposes of comparison, the procedure is repeated but without the organic phosphonate present. This leads to a rough, uneven silver deposit which has poor adhesion to the substrate.

EXAMPLE 2

The procedure of Example 1 is repeated, except that As (III) is included in the bath, in a concentration of 0.005 g/l.

The resulting silver deposit, in addition to being substantially smooth and even, has better surface brightness than the product of Example 1.

EXAMPLE 3

The procedure of Example 1 is repeated, using a deposition bath having the following composition to produce a bright, adherent silver deposit:

| | |
|---|---|
| Potassium silver cyanide | 60 g/l |
| Potassium citrate | 100 g/l |
| Organic phosphonate compound I | 30 g/l |
| Organic brightening agent, Silverex II, Sel-Rex Co. | 8 ml/l |
| pH | 7–10 |

Substantially the same result as in the foregoing examples is obtained when the other organic phosphonate compounds of this invention are used in the baths.

Other modifications and variations of the invention will suggest themselves to those skilled in the art in view of the foregoing description. It is to be understood, therefore, that changes may be made in the specific embodiments shown without departing from the scope of the invention as defined in the claims.

We claim:

1. A method for the electrodeposition of metallic silver which comprises the step of electrolizing an electroplating bath, which bath consists essentially of an aqueous solution of a composition consisting essentially of a mixture of:

(a) a soluble silver compound;

(b) a non-cyanide electrolyte; and (c) An amount of an organic phosphonate compound effective to produce a smooth, adherent silver deposit, which compound is selected from among the group consisting of:

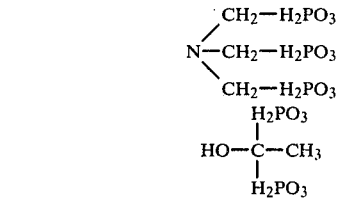

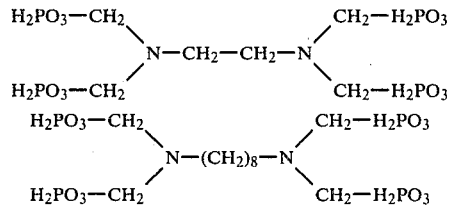

and

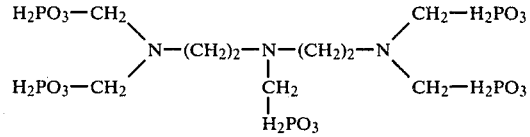

which aqueous solution has a pH above 7 and is at a temperature at which the bath produces galvanic deposits and wherein the electrolysis of said electroplating bath is carried out at a current density of at least 800 amperes/square foot to form a smooth adherent silver deposit.

2. The method as claimed in claim 1 in which the organic phosphonate compound is present in the bath in an amount of from about 10 to about 500 grams/liter.

3. The method as claimed in claim 2 in which the bath contains the organic phosphonate compound in an amount of from about 20 to about 40 grams/liter, the soluble silver compound in an amount from about 50 to about 90 grams/liter and the non-cyanide electrolyte compound in an amount of from about 90 to about 110 grams/liter.

4. The method as claimed in claim 3 in which the soluble silver compound is potassium silver cyanide and the non-cyanide electrolyte compound is potassium citrate.

5. The method as claimed in claim 4 in which the electroplating bath also contains an effective brightening amount of a brightening agent.

* * * * *